US009826777B2

(12) United States Patent
Seo et al.

(10) Patent No.: US 9,826,777 B2
(45) Date of Patent: Nov. 28, 2017

(54) FILTER AND TOBACCO USING TECHNOLOGY FOR REDUCING SMELL OF TOBACCO SMOKE ON HANDS

(75) Inventors: Man Seok Seo, Daejeon (KR); Hyun Suk Cho, Daejeon (KR); In Hyeog Oh, Daejeon (KR); Burm Ho Yang, Daejeon (KR); Han Jae Shin, Daejeon (KR); Mi Jang, Daejeon (KR); Jong Yeol Kim, Daejeon (KR)

(73) Assignee: KT&G Corporation, Daejeon (KR)

( * ) Notice: Subject to any disclaimer, the term of this patent is extended or adjusted under 35 U.S.C. 154(b) by 402 days.

(21) Appl. No.: 14/383,527

(22) PCT Filed: Aug. 29, 2012

(86) PCT No.: PCT/KR2012/006899

§ 371 (c)(1),
(2), (4) Date: Jan. 20, 2015

(87) PCT Pub. No.: WO2013/133493

PCT Pub. Date: Sep. 12, 2013

(65) Prior Publication Data

US 2015/0136159 A1 May 21, 2015

(30) Foreign Application Priority Data

Mar. 7, 2012 (KR) ..... 10-2012-0023351

(51) Int. Cl.
*A24D 3/06* (2006.01)
*A24D 3/02* (2006.01)
(Continued)

(52) U.S. Cl.
CPC ..... *A24D 3/067* (2013.01); *A24D 3/0225* (2013.01); *A24D 3/0275* (2013.01); *A24D 3/048* (2013.01); *A24D 3/14* (2013.01); *A24D 3/16* (2013.01)

(58) Field of Classification Search
USPC ..... 131/200–202, 207, 331, 365; 162/139
See application file for complete search history.

(56) References Cited

U.S. PATENT DOCUMENTS 134,713 A * 1/1873 Turner ..... B01J 47/018 252/184
3,006,806 A * 10/1961 Schur ..... D21H 17/17 162/139
(Continued)

FOREIGN PATENT DOCUMENTS

CN 1100612 A 3/1995
JP 60-40059 3/1985
(Continued)

OTHER PUBLICATIONS

English translation of KP 10-2005-0003906, K-PION Korean Patent Information Online Network, [online], retrieved from the internet, [retrieved Sep. 30, 2016], <URL:http://kposd.kipo.go.kr:8088/kiponet/up/kpion/patent/publication/selectLstPatentPublication.do>.*
(Continued)

*Primary Examiner* — Dennis Cordray
(74) *Attorney, Agent, or Firm* — Marshall, Gerstein & Borun LLP

(57) ABSTRACT

The filter using technology for reducing the smell of tobacco smoke on hands, according to one embodiment of the present invention, comprises: a filter unit for filtering tobacco smoke, the filter unit being coupled to a tobacco shred; and filter-wrapping paper for wrapping the filter unit. The filter unit or the filter-wrapping paper may contain a material for reducing the smell of tobacco smoke. According to the embodiment of the present invention, green tea extracts containing catechin or other materials for reducing the smell of tobacco smoke, e.g. citric acids, glycerols, tannic acids and the like can be added to a tobacco filter to
(Continued)

remove the smell from tobacco smoke generated during smoking, thus significantly lowering the strength of the smell of tobacco smoke on the hands of a smoker as compared to conventional tobacco filters.

13 Claims, 1 Drawing Sheet

(51) Int. Cl.

| | |
|---|---|
| ***A24D 3/04*** | (2006.01) |
| ***A24D 3/14*** | (2006.01) |
| ***A24D 3/16*** | (2006.01) |

(56) References Cited

U.S. PATENT DOCUMENTS

| | | | | |
|---|---|---|---|---|
| 3,319,630 | A * | 5/1967 | Orrmins | A24D 3/14 131/339 |
| 5,076,294 | A * | 12/1991 | Kramer | A24D 3/14 131/331 |
| 6,631,722 | B2 * | 10/2003 | MacAdam | A24D 1/12 131/331 |
| 7,481,891 | B2 * | 1/2009 | Higashi | A23G 3/36 131/274 |
| 8,613,284 | B2 * | 12/2013 | Hutchens | A24D 3/0212 131/202 |
| 2003/0159703 | A1 * | 8/2003 | Yang | A24D 3/0225 131/335 |
| 2010/0319717 | A1 * | 12/2010 | Chida | A24D 3/14 131/332 |
| 2011/0094526 | A1 * | 4/2011 | Marshall | D01F 2/00 131/332 |
| 2015/0107608 | A1 * | 4/2015 | Kadiric | A24B 15/282 131/284 |

FOREIGN PATENT DOCUMENTS

| | | | |
|---|---|---|---|
| JP | 5-115273 | | 5/1993 |
| JP | 5-505106 | | 8/1993 |
| JP | 8-291013 | | 11/1996 |
| JP | 2002-142744 | A | 5/2002 |
| JP | 2005-80641 | | 3/2005 |
| JP | 2005-080641 | A | 3/2005 |
| JP | 2009-148233 | A | 7/2009 |
| KR | 10-2005-0003906 | | 1/2005 |
| KR | 10-2006-0023107 | | 3/2006 |
| WO | WO 2013164706 | A1 * | 11/2013 |

OTHER PUBLICATIONS

Machine translation of JP 2005-080641 A, The European Patent Office, [online], retrieved on Sep. 30, 2016, [Retrieved from the Internet] <URL: https://worldwide.espacenet.com/?locale=EN_ep>.*

Catechin, Stanford Chemicals, No Date, [online], retrieved from the Internet, [retrieved Feb. 4, 2017], <URL: http://www.bestherbalextract.com/catechin.html>.*

Search Report for PCT/KR2012/006899, dated Nov. 23, 2012.

Office Action issued in Chinese Patent Application No. 201280071279.1, dated Dec. 2, 2016.

Office Action for JP 2014-560838, dated Aug. 26, 2015.

* cited by examiner

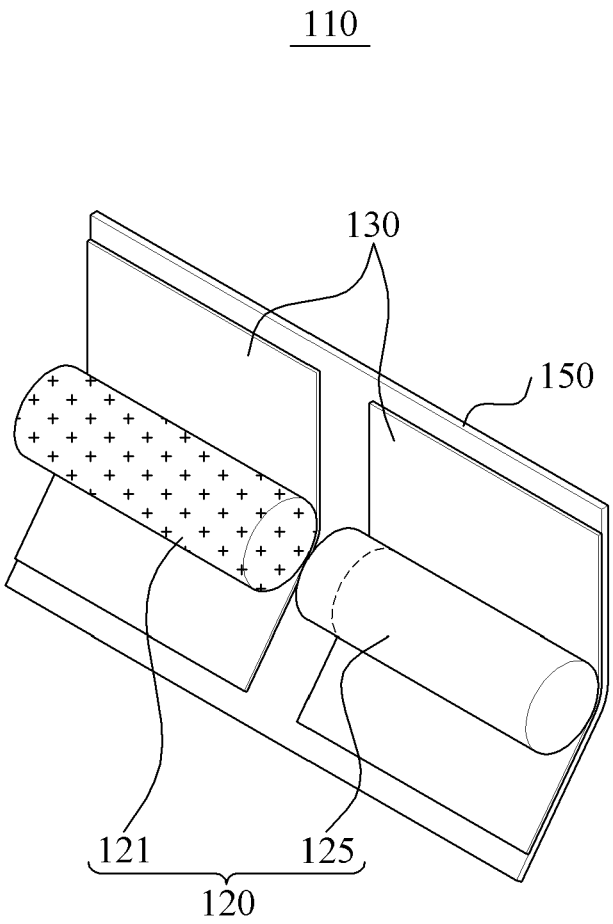
110
130
150
121
125
120

FILTER AND TOBACCO USING TECHNOLOGY FOR REDUCING SMELL OF TOBACCO SMOKE ON HANDS

TECHNICAL FIELD

The present invention relates to a filter using a technology for reducing a cigarette smoke smell on hands, and a cigarette, and more particularly to a filter using a technology for reducing a cigarette smoke smell on hands which adds a cigarette smoke smell removing material to a cigarette filter to remove a smell from cigarette smoke caused during smoking and to thus significantly lower intensity of a cigarette smoke smell lingering on a hand of a smoker, and a cigarette.

BACKGROUND OF THE INVENTION

It is generally known that cigarette smoke caused from smoking includes harmful substances to the human body, such as tar or nicotine. Therefore, removing materials included in the smoke which damage to the human body is crucial, and a filter is attached to a cigarette accordingly.

Cigarette smoke may linger on fingers of a smoker holding a cigarette filter, causing displeasure due to the smell to not only the smoker but people around the smoker. Thus, the smoker often washes the hands to remove the cigarette smoke smell lingering on the hands after smoking.

However, the smoker may be in a situation of not being able to wash the hands after smoking or it may bother the smoker to wash the hands whenever smoking.

Accordingly, there is a need to develop a cigarette whose smell minimally lingers on the hands after smoking.

SUMMARY OF THE INVENTION

Technical Problems

An aspect of the present invention is to provide a filter using a technology for reducing a cigarette smoke smell on hands which adds a green tea extract containing catechin and citric acid, glycerol or tannic acid to a cigarette filter to remove a smell from cigarette smoke caused during smoking and to thus significantly lower intensity of a cigarette smoke smell lingering on a hand of a smoker as compared to conventional tobacco filters, and a cigarette.

Technical Solutions

According to an aspect of the present invention, there is provided a filter using a technology for reducing smell of cigarette smoke on hands, the filter including a filter unit coupled to a tobacco shred of a cigarette to filter cigarette smoke; and a filter wrapping paper to wrap the filter unit, wherein the filter unit or filter wrapping paper includes a cigarette smoke smell removing material for reducing smell of cigarette smoke, and accordingly a smell from cigarette smoke caused during smoking may be reduced, thus significantly lowering intensity of the smell of cigarette smoke lingering on the hands as compared to conventional tobacco filters The cigarette smoke smell removing material may include any one or a mixture of catechin, citric acid, glycerol, tannic acid or β-cyclodextrin, scoria, titanium dioxide ($TiO_2$), zeolite, zeolite-X, tourmaline, a *Houttuynia cordata* extract, a *Paeonia japonica* extract and flavonoid.

The cigarette smoke smell removing material may include at least one or a mixture of catechin, citric acid, glycerol, tannic acid and β-cyclodextrin.

The cigarette smoke smell removing material included in the filter unit or filter wrapping paper may include 2 to 25% of catechin.

The cigarette smoke smell removing material may include 15 to 20% of catechin.

The cigarette smoke smell removing material may be included in the filter unit or filter wrapping paper via coating or dipping, or be mixed with a liquid to be sprayed onto the filter unit or filter wrapping paper.

The filter unit or filter wrapping paper may include a green tea extract including catechin as a main component; and at least one of citric acid, glycerol and tannic acid.

The green tea extract may be extracted via a first process of mixing green tea leaves, PG at a preset weight ratio to the green tea leaves and alcohol and heating a mixture at a preset temperature for a predetermined time, and then a second process of additionally mixing with alcohol and heating for a preset time. The extract obtained via the first and second processes is concentrated to a final viscosity of 60 to 80 Brix The citric acid or glycerol may be present in an amount of 1 to 20% in the filter unit or filter wrapping paper.

The filter may further include a tipping paper to cover an outside of the filter wrapping paper and to include the cigarette smoke smell removing material.

According to another aspect of the present invention, there is provided a method of manufacturing a cigarette filter including a filter unit coupled to a tobacco shred of a cigarette to filter cigarette smoke and a filter wrapping paper coupled to the filter unit, wherein a green tea extract including catechin as a main component is added to the filter unit or the filter wrapping paper, and a cigarette smoke smell removing material for reducing a cigarette smoke smell is further added to the filter unit or the filter wrapping paper including the green tea extract. As such, a green tea extract containing catechin and other cigarette smoke smell removing materials, such as citric acid, glycerol or tannic acid, are added to a cigarette filter to remove a smell from cigarette smoke caused during smoking, thus significantly lowering the intensity of the smell of cigarette smoke lingering on the hands of a smoker as compared to conventional tobacco filters.

The cigarette smoke smell removing material may include any one or a mixture of citric acid, glycerol, tannic acid and β-cyclodextrin.

The filter unit or the filter wrapping paper may be manufactured to include the green tea extract containing 5 to 25% catechin as a main component and be soaked in a solution including at least one of 5 to 60% citric acid and glycerol.

According to still another aspect of the present invention, there is provided a cigarette including a tobacco shred; a cigarette filter connected to the tobacco shred; and a tipping paper to cover the cigarette filter and part of the tobacco shred coupled to the cigarette filter, wherein the cigarette filter includes a filter unit to filter smoke of the cigarette and a filter wrapping paper to wrap the filter unit.

The filter unit or filter wrapping paper may include a cigarette smoke smell removing material for reducing smell of the cigarette.

The cigarette smoke smell removing material may be present inside the tipping paper, and the cigarette smoke smell removing material may include at least one of catechin, citric acid, glycerol, tannic acid and β-cyclodextrin.

The filter unit or the filter wrapping paper may be manufactured to include the green tea extract containing 5 to 25% catechin as a main component and be soaked in a solution including at least one of 5 to 60% citric acid and glycerol.

Advantageous Effects

According to one embodiment of the present invention, a green tea extract containing catechin and other cigarette smoke smell removing materials, such as citric acid, glycerol or tannic acid, are added to a cigarette filter to remove a smell from cigarette smoke caused during smoking According to one embodiment of the present invention, a green tea extract containing catechin and citric acid, glycerol or tannic acid are added to a cigarette filter to remove a smell from cigarette smoke caused during smoking, thus significantly lowering the intensity of the smell of cigarette smoke lingering on the hands of a smoker as compared to conventional tobacco filters.

BRIEF DESCRIPTION OF DRAWINGS

FIG. 1 is a diagram schematically illustrating a configuration of a cigarette filter according to an embodiment of the present invention.

DETAILED DESCRIPTION

Hereinafter, a configuration and an application according to one exemplary embodiment of the present invention will be described in detail with reference to the accompanying drawings. The following description is one of different aspects of the present invention and is part of the detailed description of the present invention.

In describing the present invention, the detailed description of a known function or configuration will be omitted herein in order to clarify the gist of the present invention.

FIG. 1 is a diagram schematically illustrating a configuration of a cigarette filter according to an embodiment of the present invention.

The cigarette filter 110 according to the embodiment is a component forming a cigarette along with a tobacco shred (not shown) and includes, as shown in FIG. 1, a filter unit 120 coupled to the tobacco shred to filter cigarette smoke and a filter wrapping paper 130 to wrap the filter unit 120.

Here, the filter unit 120 may include a first filter member 121 coupled to the tobacco shred and including activated carbon and a second filter member 125 disposed to be coupled to the first filter member 121 and including cellulose acetate. The first filter member 121 and the second filter member 125 are wrapped in separate filter wrapping papers 130, and the filter unit 120 is entirely wrapped in a tipping paper 150.

Here, the first filter member 121, the second filter member 125, the filter wrapping papers 130, or the tipping paper 150 may include a cigarette smoke smell removing material for reducing a cigarette smoke smell, and thus a smell caused by side-stream (or mainstream) smoke of the cigarette smoke may less linger on a hand of a smoker after smoking.

In the present embodiment, the tipping paper 150 completely wraps the cigarette filter 110 and covers even part of the tobacco shred. Thus, the cigarette smoke smell removing material may be included in the tipping paper 150.

The filter unit 120 is not limited to the foregoing configuration but may be also configured as a multiple filter, for example, a triple filter and a cavity filter. In addition, although the first filter member 121 includes activated carbon and the second filter member 125 includes cellulose acetate in the aforementioned description, the filter members are not limited to the foregoing materials and kinds.

Conventionally, in tobacco smoking, as mentioned above, a smell due to side-stream smoke lingers on a hand of a smoker to cause displeasure to the smoker and people around the smoker and the smoker has inconvenience of washing the hands after smoking. The present embodiment may resolve the foregoing problems by removing a cigarette smoke smell.

Referring to FIG. 1, the filter members 121 and 125, particularly the second filter member 125 including acetate, the filter wrapping paper 130 wrapping the filter members 121 and 125, and the tipping paper 150 may include the cigarette smoke smell removing material.

Here, the cigarette smoke smell removing material may be a green tea extract including catechin as a main component, citric acid, glycerol, tannic acid or β-cyclodextrin, or a mixture thereof. However, the cigarette smoke smell removing material may not be limited to these materials.

The cigarette smoke smell removing material, for example, a green tea extract including catechin as a main component, citric acid and glycerol, may be included in the filter wrapping paper 130 wrapping the filter members or in the tipping paper 150 via coating or dipping, or be mixed with a liquid to be sprayed onto the filter wrapping paper 130 or the tipping paper 150. Accordingly, a cigarette smoke smell may be reduced.

Also, the cigarette smoke smell removing material may be mixed with a liquid, such as water, to be spayed, for example, onto the second filter member 125 including acetate, so that the cigarette smoke smell removing material may be evenly distributed in the second filter member 125.

When the cigarette smoke smell removing material is included in the configuration of the cigarette filter 110, nicotine as a main factor of a cigarette smoke smell by side-stream smoke may be decreased by about 30%, pyridine by about 13%, and 3-ethyl pyridine by about 40%, thereby reducing a cigarette smoke smell, which will be described in detail.

Hereinafter, the configuration of the cigarette filter 110 according to the present embodiment and a method of manufacturing the same will be described with reference to tables listed below.

TABLE 1

| Contributing factor | Caused in total (Side-stream smoke + perforations) | Caused by side-stream smoke | Caused by perforations |
|---|---|---|---|
| Nicotine (ng/pad) | 4,778 (100%) | 1,274 (27%) | 3,504 (73%) |
| Pyridine (ng/pad) | 709 (100%) | 312 (44%) | 397 (56%) |

To test a cigarette smoke smell reducing effect of the cigarette filter according to the present embodiment, transferable components including nicotine, pyridine and 3-ethyl pyridine as major factors of a cigarette smoke smell by side-stream smoke are selected as indicators. As a result of investigating distributions of cigarette smoke smell factors on the hands by side-stream smoke and of cigarette smoke smell factors by perforations of the tipping paper, nicotine is generated about 73% in the perforations, and pyridine is produced 56% in the perforations, as illustrated in Table 1. That is, the result shows that a cigarette smoke smell lingers on the hands greater by the perforations of the tipping paper.

Here, to analyze a cigarette smoke smell lingering on the hands, the tipping paper of the cigarette is covered with a glass fiber pad, after which components collected in the glass fiber pad after burning the cigarette are analyzed using an analysis method using solid-phase microextraction (SPME) combined with gas chromatography-mass spectrometry (GC/MS), SPME-GC/MS. Accordingly, smoke amount and a component difference according to smoke capacity (each cigarette) may be identified, and even smoke amount and a component difference by cigarette kind may be identified.

Table 2 illustrates nicotine reduction rate according to cigarette smoke smell removing materials (deodorizing materials), based on which a cigarette smoke smell removing material may be selected.

TABLE 2

| Deodorizing material | Nicotine reductionrate (%) | Deodorizing material | Nicotine reduction rate (%) | Deodorizing material | Nicotine reduction rate (%) |
|---|---|---|---|---|---|
| Catechin (50%) | 50 | $TiO_2$ | 30 | *Houttuynia cordata* extract | 8 |
| Tannic acid | 49 | Zeolite | 24 | *Paeonia japonica* extract | 4 |
| β-cyclodextrin | 48 | Zeolite-X | 19 | Flavonoid | 1 |
| Scoria | 38 | Tourmaline | 14 | | |

First, according a nicotine analysis method, 10 ml of a 0.1 mg/ml nicotine solution (in IPA, isopropanol with heptadecane) is mixed with 0.5 g of a deodorizing material in a 30-ml conical tube, followed by a centrifugal process after 5 minutes, after which a supernatant is subjected to gas chromatography (GC) to analyze nicotine concentration, and nicotine analysis results are listed in Table 2.

Table 2 shows that among a plurality of deodorizing materials, catechin, tannic acid and β-cyclodextrin are appropriate as a cigarette smoke smell removing material.

Table 3 illustrates nicotine reduction rate and collected nicotine content according to concentration of catechin having a relatively high nicotine reducing effect.

TABLE 3

| Catechin content (%) | Analysis of nicotine caused from tipping paper: Nicotine peak area | Nicotine reduction rate (%) | Nicotine content of smoke collected in pad (%) |
|---|---|---|---|
| 0 | 46,676,796 ± 10,123,846 | 0 | 7.1 |
| 5 | 29,795,231 ± 23,284 | 36 ± 4 | 3.7 |
| 10 | 33,123,996 ± 11,745,404 | 29 ± 25 | 3.6 |
| 15 | 15,603,072 ± 3,277,661 | 66 ± 7 | 2.4 |
| 20 | 14,269,073 ± 5,555,971 | 69 | 2.1 |
| 25 | 17,192,751 ± 8,010,663 | 63 ± 17 | 2.1 |

Filter wrapping papers each including 0, 5, 10, 15, 20 and 25% of catechin are prepared, filter members are covered with the respective filter wrapping papers, and tipping papers wrapped around the filter wrapping papers are wrapped in glass fiber pads. After burning the cigarettes, nicotine content collected in the glass fiber pads are analyzed with SPME-GC/MS. As a result, as illustrated in Table 3, when catechin content is 20%, the nicotine reduction rate is highest, which means that nicotine content is lowest.

Here, although the nicotine reduction rate grows and nicotine content decreases with catechin content increasing in a catechin content range from 0 to 20%, the nicotine reduction rate decreases again when catechin content exceeds 20%.

Accordingly, it is verified that catechin selectively removes nicotine, wherein when a filter wrapping paper including 5 to 25%, preferably 20% of catechin, is used, a cigarette smoke smell lingering on the hands in tobacco smoking may be reduced.

Since catechin is contained in green tea in large quantities, a green tea extract may be used as a cigarette smoke smell removing material. A green tea extract may be extracted via a first process of mixing green tea leaves, 5% by weight of PG based on weight of green tea leaves and alcohol ten times as much and heating the mixture, for example, at 50° C. for a predetermined time, and then a second process of adding alcohol eight times as much and heating at 50° C. The extract obtained via the first and second processes is concentrated into 70 Brix to be used for experiments. Here, the green tea extract may contain 8% of catechin, but catechin content of the green tea extract is not limited thereto.

Table 4 illustrates a nicotine reduction in a cigarette filter containing the green tea extract.

TABLE 4

| Classification | Green tea extract content in filter (%): 0 (control) | 10 (experiment) | Reduction rate (%) |
|---|---|---|---|
| TPM (mg/cig.) | 40.99 ± 2.44 | 40.16 ± 2.69 | — |
| Nicotine (mg/cig.) | 0.96 ± 0.04 | 0.81 ± 0.04 | 15.7 |

As shown above, a cigarette filter containing 10% of the green tea extract includes a lower nicotine content than a cigarette filter containing no green tea extract and has a reduction rate of 15.7%.

Table 5 illustrates amounts of a plurality of cigarette smoke smell removing materials added in a green tea extract containing filter and a non-green tea extract containing filter, and Table 6 illustrates analysis results of content of nicotine lingering on the hands when a cigarette smoke smell removing material is added to a green tea extract containing filter and a non-green tea extract containing filter.

TABLE 5

| Classification | Amount of added deodorizing material (mg/tip): Green tea extract containing filter | Non-green tea extract containing filter |
|---|---|---|
| Control (no addition) | 0 | 0 |
| Glycerol | 71.31 | 110.88 |
| Citric acid | 53.10 | 40.76 |

TABLE 5-continued

| Classification | Amount of added deodorizing material (mg/tip) | |
|---|---|---|
| | Green tea extract containing filter | Non-green tea extract containing filter |
| Cyclodextrin | 1.38 | 2.00 |
| Flavonoid | 0.05 | 0.05 |
| Tannic acid | 34.14 | 30.65 |

TABLE 6

| Deodorizing material added to filter | Analysis of content of nicotine lingering on hands (ng/pad) | |
|---|---|---|
| | Green tea extract containing filter | Non-green tea extract containing filter |
| +Control (+water) | 6,360 | 9,953 |
| +Citric acid | 4,003 | 3,610 |
| +Flavonoid | 9,795 | 11,642 |
| +Glycerol | 1,835 | 1,651 |
| +Tannic acid | 6,072 | 3,495 |
| +Cycrodextrin | 8,460 | 10,308 |

Referring to Table 5, a green tea extract containing filter is prepared and is soaked in a solution including a cigarette smoke smell removing material (glycerol, citric acid, cyclodextrin, flavonoid and tannic acid) to produce a cigarette filter, in which each cigarette smoke smell removing material is added in amounts listed above in Table 5.

Subsequently, a tipping paper is wrapped in a glass fiber pad and nicotine content collected in the glass fiber pad is analyzed using SPME-GC/MS. As a result, as in Table 6, a cigarette using the green tea extract containing filter has a low transition of nicotine as compared with a cigarette using the non-green tea extract containing filter. In addition, as a result of analyzing synergy effects between the cigarette smoke smell removing materials (deodorizing components), when citric acid or glycerol is added, nicotine content lingering on the hands is remarkably reduced comparatively.

For reference, Table 7 illustrates results of verifying a nicotine removing effect from mainstream smoke.

TABLE 7

| Deodorizing material added to filter | Comparison of content of general components shifting to mainstream smoke | | | | | | | |
|---|---|---|---|---|---|---|---|---|
| | Green tea extract containing filter | | | | Non-green tea extract containing filter | | | |
| | TPM | Tar | Nicotine | T/N ratio | TPM | Tar | Nico-tine | T/N ratio |
| +Control (+water) | 7.3 | 6.0 | 0.51 | 11.7 | 5.3 | 4.4 | 0.42 | 10.6 |
| +Citric acid | 5.5 | 4.5 | 0.34 | 13.4 | 5.2 | 4.3 | 0.34 | 12.7 |
| +Flavonoid | 7.0 | 5.5 | 0.49 | 11.2 | 5.7 | 4.8 | 0.41 | 11.7 |
| +Glycerol | 5.8 | 5.0 | 0.36 | 13.9 | 5.4 | 4.7 | 0.35 | 13.4 |
| +Tannic acid | 6.2 | 5.3 | 0.40 | 13.1 | 5.9 | 5.0 | 0.38 | 13.0 |
| +Cycrodextrin | 6.5 | 5.5 | 0.47 | 11.6 | 5.8 | 4.8 | 0.43 | 11.0 |

As a result of analyzing TPM, tar and nicotine in mainstream smoke from cigarettes employing a green tea extract containing filter and a non-green tea extract containing filter, each of which includes a cigarette smoke smell removing material (deodorizing component), as in Table 7, a cigarette using the green tea extract containing filter has a low transition of nicotine per tar (T/N ratio) as compared with a cigarette employing the non-green tea extract containing filter. Also, as a result of analyzing synergy effects between the cigarette smoke smell removing materials (deodorizing components), when a filter containing citric acid, glycerol or tannic acid is used, nicotine content lingering on the hands is remarkably reduced comparatively.

Table 8 illustrates nicotine content lingering on the hands when a green tea extract containing filter and a non-green tea extract containing filter are soaked in a solution including a cigarette smoke smell removing material in different concentrations.

TABLE 8

| Deodorizing material added to filter | Analysis of content of nicotine lingering on hands (ng/pad) | |
|---|---|---|
| | Green tea extract containing filter | Non-green tea extract containing filter |
| Control (+water) | 6,560 | 9,870 |
| +Glycerol 5% | 5,453 | 8,546 |
| +Glycerol 10% | 4,795 | 7,655 |
| +Glycerol 30% | 4,505 | 7,546 |
| +Glycerol 60% | 4,464 | 7,478 |
| +Citric acid 5% | 6,357 | 8,756 |
| +Citric acid 10% | 5,005 | 7,060 |
| +Citric acid 30% | 4,965 | 6,965 |
| +Citric acid 60% | 4,864 | 6,864 |

A green tea extract containing filter and a non-green tea extract containing filter are soaked in solutions containing glycerol and citric acid in different concentrations as cigarette smoke smell removing materials (deodorizing components) that remarkably reduce nicotine, thereby producing cigarettes employing cigarette filters with glycerol or citric acid applied in different concentrations. Subsequently, a tipping paper of each produced cigarette is wrapped in a glass fiber pad and nicotine content collected in the glass fiber pad while burning the cigarette is analyzed using SPME-GC/MS. Results are shown in Table 8.

The analysis results show that when glycerol or citric acid is applied to the green tea extract containing filter and the non-green tea extract containing filter, nicotine content decreases with concentrations thereof increasing and is optimal in the concentrations of glycerol and citric acid of 10% considering a nicotine reducing effect and the concentrations of the cigarette smoke smell removing materials.

Table 9 illustrates nicotine content lingering on the hands in a cigarette sample employing a green tea extract containing filter and in a cigarette sample employing a green tea extract and glycerol containing filter.

TABLE 9

| Cigarette sample | Analysis category | | |
|---|---|---|---|
| | Tar from mainstream smoke (mg/cig) | Nicotine lingering on hands (ng/pad) | Reduction rate (%) |
| Control | 1.5 | 10,951 | — |
| Experiment (green tea) | 1.6 | 6,331 | 43.2 |
| Experiment (green tea + glycerol) | 1.7 | 5,366 | 51.0 |

As illustrated above, the cigarette sample employing the green tea extract containing filter has a cigarette smoke smell lingering on the hands reduced by 43.2% as compared with the control, while the cigarette sample employing the filter containing the cigarette smoke smell removing material, glycerol, has a cigarette smoke smell lingering on the hands reduced by 51.0% as compared with the control. That is, nicotine reduction rate is higher and thus a cigarette smoke smell lingering on the hands is reduced greater when a cigarette smoke smell removing material is added for a synergy effect than when only the green tea extract is added.

For reference, functionality evaluation may be carried out for determining whether a cigarette smoke smell reducing effect is exhibited. That is, after cigarettes employing a filter containing a green tea extract and a cigarette smoke smell removing material are manufactured, smokers smoke the cigarettes, wearing cotton gloves, and non-smokers evaluate intensity of a cigarette smoke smell using the gloves. As a result of an experiment of 18 non-smokers, 16 people judge that the intensity of the cigarette smoke smell is reduced. That is, as mentioned above, when a green tea extract and a cigarette smoke smell removing material are applied to a filter, a cigarette smoke smell lingering on the hands is actually reduced.

As described above, according to the embodiment of the present invention, a green tea extract containing catechin and other cigarette smoke smell removing materials, such as citric acid, glycerol or tannic acid, are added to a cigarette filter to remove a smell from cigarette smoke caused during smoking, thus significantly lowering the intensity of the smell of cigarette smoke lingering on the hands of a smoker as compared to conventional tobacco filters.

It will be apparent to those skilled in the art that the present invention is not limited to the aforementioned embodiment but may be changed and modified in various ways without departing from the idea and scope of the present invention. Thus, other modifications and alternative embodiments are construed as being within the appended claims.

The invention claim is:

1. A cigarette filter using a technology for reducing smell of cigarette smoke on hands, the cigarette filter comprising:

a filter unit coupled to a tobacco shred of a cigarette to filter cigarette smoke;

a filter wrapping paper to wrap the filter unit, and a tipping paper to cover an outside of the filter wrapping paper and compromising a cigarette smoke smell removing material for reducing smell of cigarette smoke, wherein the filter unit or filter wrapping paper comprises the cigarette smoke smell removing material for reducing smell of cigarette smoke, and wherein the cigarette smoke smell removing material comprises any one or a mixture of catechin, citric acid, tannic acid, scoria, zeolite-X, tourmaline, a Houttuynia cordata extract, a Paeonia japonica extract and flavonoid.

2. The filter of claim 1, wherein the cigarette smoke smell removing material further comprises any one or a mixture of glycerol, β-cyclodextrin, titanium dioxide (TiO2) and zeolite.

3. The filter of claim 1, wherein the cigarette smoke smell removing material comprises at least one or a mixture of catechin, citric acid, glycerol and tannic acid.

4. The filter of claim 1, wherein the cigarette smoke smell removing material comprised in the filter unit or filter wrapping paper comprises 2 to 25% of catechin.

5. The filter of claim 1, wherein the cigarette smoke smell removing material comprises 15 to 20% of catechin.

6. The filter of claim 1, wherein the cigarette smoke smell removing material is comprised in the filter unit or filter wrapping paper via coating or dipping, or is mixed with a liquid to be sprayed onto the filter unit or filter wrapping paper.

7. The filter of claim 1, wherein the filter unit or filter wrapping paper comprises a green tea extract comprising catechin as a main component; and at least one of citric acid, glycerol and tannic acid.

8. The filter of claim 7, wherein the green tea extract is extracted via a first process of mixing green tea leaves, PG (propylene glycol) at a preset weight ratio to the green tea leaves, and alcohol and heating the mixture at a preset temperature for a predetermined time, and then a second process of additionally mixing with alcohol and heating for a preset time.

9. The filter of claim 7, wherein the citric acid or glycerol is present in an amount of 1 to 20% in the filter unit or filter wrapping paper.

10. A method of manufacturing a cigarette filter comprising a filter unit coupled to a tobacco shred of a cigarette to filter cigarette smoke and a filter wrapping paper coupled to the filter unit, wherein a green tea extract comprising catechin as a main component is added to the filter unit or the filter wrapping paper, and a further cigarette smoke smell removing material for reducing a cigarette smoke smell is added to the filter unit or the filter wrapping paper comprising the green tea extract and wherein the green tea extract contains as a main component 5 to 25% catechin and the filter unit or the filter wrapping paper is soaked in a solution comprising at least one of 5 to 60% citric acid and 5 to 60% glycerol.

11. The method of claim 10, wherein the further cigarette smoke smell removing material comprises any one or a mixture of citric acid, glycerol, tannic acid and β-cyclodextrin.

12. A cigarette comprising:

a tobacco shred;

a cigarette filter connected to the tobacco shred; and a tipping paper to cover the cigarette filter and part of the tobacco shred coupled to the cigarette filter, wherein the cigarette filter comprises:

a filter unit to filter smoke of the cigarette; and a filter wrapping paper to wrap the filter unit, wherein the filter unit or filter wrapping paper comprises a cigarette smoke smell removing material for reducing smell of the cigarette, and wherein the cigarette smoke smell removing material is present inside the tipping paper, and wherein the filter unit or the filter wrapping paper is manufactured to comprise a green tea extract containing as a main component 5 to 25% catechin and the filter unit or the filter wrapping paper is soaked in a solution comprising one of 5 to 60% citric acid and 5 to 60% glycerol.

13. The cigarette of claim 12, wherein the cigarette smoke smell removing material comprises at least one of catechin, citric acid, glycerol, tannic acid and β-cyclodextrin.

* * * * *